United States Patent [19]

Matkan et al.

[11] 4,362,764

[45] Dec. 7, 1982

[54] ELECTROSTATIC PRINTING OF MARKERS FOR CUTTING FABRIC INVOLVES IMAGE TRANSFER AND TWO TONERS

[75] Inventors: Josef Matkan, Malvern; Robert J. Wright, Blackwood, both of Australia

[73] Assignee: Better Methods, Inc., Secaucus, N.J.

[21] Appl. No.: 283,205

[22] Filed: Jul. 14, 1981

[30] Foreign Application Priority Data

Jul. 24, 1980 [AU] Australia ..... PE4678/80

[51] Int. Cl.[3] ..... B05D 1/06

[52] U.S. Cl. ..... 427/14.1; 427/25; 427/32; 427/145; 427/179; 427/375; 427/411; 430/126; 430/49; 430/113; 430/114; 118/644; 118/649; 118/660; 83/14

[58] Field of Search ..... 430/49, 126; 33/11, 33/12, 13, 14; 118/644; 427/14.1, 25, 32; 83/14

[56] References Cited

U.S. PATENT DOCUMENTS 3,355,288 11/1967 Matkan ..... 430/126
3,368,894 2/1968 Matkan et al. ..... 430/126
3,862,848 1/1975 Marley ..... 430/74
3,888,664 6/1975 Carlson ..... 430/126 X

FOREIGN PATENT DOCUMENTS 944266 2/1968 Australia .
5006869 8/1970 Australia .
6067873 3/1975 Australia .

*Primary Examiner*—John D. Welsh
*Attorney, Agent, or Firm*—Morgan, Finnegan, Pine, Foley & Lee

[57] ABSTRACT

The method of and means for the production of markers for the cutting of fabric or material in the garment or allied industries comprising forming a latent electroscopic image pattern on the surface of a dielectric master and toning the image with a primary toner and transferring the primary image toner to a conductive receiving member and fixing and then toning the fixed image with a secondary toner and transferring optionally to the fabric or material or to multiple copy members for marking fabric or material.

21 Claims, 2 Drawing Figures

ELECTROSTATIC PRINTING OF MARKERS FOR CUTTING FABRIC INVOLVES IMAGE TRANSFER AND TWO TONERS

BACKGROUND OF THE INVENTION

In the apparel and related industries it is customary to use a so-called marker for cutting of materials or fabrics. The marker comprises a sheet of paper on which are printed in essence lines defining the contours of various pieces of fabric forming various parts of a garment which is made by sewing together such pieces of fabric. The marker is laid over a stack formed by a number of fabric layers, or in certain cases over a single fabric layer, and the fabric is cut through the marker by a cutter which follows precisely the contour lines printed thereon. For each fabric stack cutting a new marker is required because the marker is destroyed in the process and therefore it is economically necessary to use cheap paper for the marker, particularly since in many instances up to 100 or even more markers are needed to cut the number of stacks or quantity of fabric for the required number of garments.

There are various methods of imprinting the contour lines on the markers and one such method is as follows. By appropriate electronic data manipulation the contour line configuration for a specific garment is stored as a programme in a computer which operates a plotter as is well known in the art. The output from the plotter is a sheet of paper containing thereon a printout of the contour lines and such plotter output is then used as a duplicating master for generating a number of copies which then serve as markers.

Marker generation by copying from the duplicating master is carried out as follows. The plotter printout is produced by signal addressed styli contacting a dielectric paper and forming an electrostatic charge pattern thereon corresponding to the information to be printed that is the contour lines. The dielectric paper surface is then contacted with a liquid toner as is well known in the art, that is electroscopic marking particles dispersed in a so-called carrier liquid, whereby such electroscopic marking particles or toner material becomes attracted by said electrostatic charges and forms patternwise deposits on the dielectric paper surface. The toner material is of a composition adapted to form hectographic printing deposits that is to say it contains alcohol soluble dyes and thus the plotter output becomes a hectographic duplicating master for the generation of copies therefrom or markers by hectographic or so-called spirit duplication, as is well known in the art. In the process of duplication, the hectographic master is usually mounted on or passed over a rotating cylinder; the copy paper is moistened with alcohol or a mixture of water and alcohol and is brought into intimate contact with the printing surface of the master whereby the alcohol in the copy paper dissolves some of the spirit soluble dye contained in the printing deposits on said printing surface and such dissolved dye becomes absorbed by the moistened copy paper forming a dye image thereon. Upon evaporation of the alcohol the dye image becomes fixed to the copy paper. Subsequent copies are made by repeating the steps of moistening the copy paper and contacting it with the printing surface of the master.

It has been found in practice that by the above described method in many instances it is not possible to produce the required number such as up to 100 markers from one dielectric paper base hectographic master because such masters due to the nature of the dielectric paper base and hectographic toner deposit formed thereon show severe copy density deterioration after only about 15 or so copies. Thus in those instances where more than about 15 markers are required it is necessary to produce in the plotter further duplicating masters on dielectric paper, which is time consuming and expensive in view of the high cost of the dielectric paper. Thus there is need for increasing substantially the number of copies or markers which can be generated from one and the same dielectric paper base output produced in the plotter.

It is known to develop a latent electrostatic image on a dielectric sheet by a coloured toner and to electrically transfer the toner to a first and even to a second surface but this only involves transferring a single developed image at a time. Such a method is shown in the specification of Australian Letters Patent No. 469,940 and the corresponding U.S. Pat. No. 3,862,848.

SUMMARY OF THE INVENTION

It is therefore the object of this invention to provide a method of and means for producing an inexpensive duplicating master which is capable of generating in excess of 100 copies or markers.

Another object of this invention is to provide a duplicating master which is produced by a method whereby the dielectric paper comprising the plotter output can be reused many times.

A further object of this invention is to provide a method of and means for producing copies or markers from a dielectric paper comprising the plotter output where such dielectric paper can be reused many times.

A still further object of this invention is to provide a method of and means for producing copies or markers from a dielectric paper comprising the plotter output whereby such copies or markers can themselves be used as duplicating masters if so desired for the generation of a limited number of further copies or markers and where such dielectric paper can be reused many times.

The above objects and other advantages are accomplished in accordance with this invention by employing electrostatic duplication for the generation of copies or markers and by producing the electrostatic duplicating master and in certain instances by producing the copies or markers by image transfer from a reusable plotter output, as will be described in more detail in the following.

DESCRIPTION OF THE INVENTION

In the well known art of electrostatic printing or duplication it is customary to employ an electrostatic master having a printing surface which comprises relatively conductive background or non-image areas and relatively insulative or dielectric image or printing areas corresponding to the information to be printed. The conductive or relatively conductive background area may be the surface of a metal plate or coated paper or a photoconductive recording member or the like whereas the image areas which will be referred to henceforth as primary image deposits can be formed by deposits of dielectric material. In the process of duplication such electrostatic master is usually placed over a conductive support member such as a rotating cylinder which is connected to the terminal of one polarity of a high tension DC power supply whereas the terminal of the other polarity of such power supply is connected to corona or electrostatic field generating means positioned near the printing surface of said electrostatic master to apply electrostatic charge to the primary image deposits contained thereon. Subsequently electroscopic marking particles generally referred to as toner material which may be of dry powder type or of liquid dispersed type as is well known in the art, henceforth referred to as secondary toner, are applied to the printing surface. Such toner material is attracted to the charged primary image deposits and forms a toner material deposit thereon which toner deposits will be referred to henceforth as the secondary image deposit. Such secondary image deposit is then transferred electrostatically or by other means such as pressure as is well known in the art onto a receiving member such as a sheet of plain copy paper on which such transferred secondary image deposit is subsequently affixed by solvent evaporation, heat fusion, pressure or other means. Subsequent copies are generated in like manner by recharging the primary image deposits, forming secondary image deposits thereon and transferring the secondary image deposits to consecutive copy sheets.

It should be noted that in certain instances it is not necessary to recharge the primary image deposits following the electrostatic transfer therefrom of the secondary image deposits onto the copy paper as the corona or electrostatic field generating means can be constructed to operate in such manner that after one initial step of applying electrostatic charge to the primary image deposits to attract secondary toner material thereto for the formation of the secondary image deposit which is to be transferred to the first copy sheet, the electrostatic field applied during the step of transferring the secondary image deposits to a copy sheet also effects recharging of or maintaining of charge on the primary image for attraction thereto of secondary toner material to form secondary image deposits for transfer onto a subsequent copy sheet.

The electrostatic master referred to in the foregoing is prepared in accordance with this invention as follows. The plotter output that is the dielectric paper containing on its surface an electrostatic charge pattern corresponding to the information to be printed that is the contour lines is contacted with primary toner material which is dielectric or insulative and is attracted by said electrostatic charges. The patternwise deposits formed by such primary toner on the dielectric paper surface are transferred electrostatically or by other means onto an electrically conductive or relatively conductive coating contained on at least one side of a paper sheet and are affixed thereto to form primary dielectric image deposits on said conductive surface and thereby to produce an electrostatic duplicating master.

The primary toner material comprises dielectric or insulative electroscopic marking particles which may be applied in the form of dry powder by known toning methods or such electroscopic marking particles may be in liquid dispersed form. Such primary toner material may consist of insulative and preferably thermoplastic polymeric substances such as polystyrene, acrylics, ketone resins, epoxy, polyethylene and the like, waxes, and colouring matter such as pigments may also be included provided they do not lower the insulative properties of the toner material. In the case of liquid toners other substances such as dispersing agents and charge directors or polarity control agents can also be included. It is however important that such primary toner is capable of forming on the dielectric paper toner deposits which can be transferred to the conductive coating on the master base paper virtually completely so that as little as possible residue remains on the dielectric paper surface.

Upon transfer onto the conductive coating the primary toner deposits can be affixed thereto by application of heat or warm air whereby the thermoplastic dry or liquid toner materials are caused to melt and adhere to the conductive coating and it will be realised that if such materials are applied from liquid dispersion the carrier liquid or solvent may be evaporated prior to or during such heat fixing step. In the case of liquid toners it is also possible to use so-called self-fixing toner materials which affix the toner deposit to the conductive coating upon evaporation of the carrier liquid or solvent. Accordingly in order to attain good adhesion or bonding it is also necessary for such primary toner materials to be compatible with the substance forming the conductive coating on the master base paper. Furthermore it is also necessary for such primary toner material to be so selected that the fused or fixed primary image deposits on said conductive coating are solvent resistant that is to say they are not dissolved or swelled or tackified or otherwise affected by the carrier liquid of the secondary toner in those instances where such secondary toner is of the liquid type.

As has been stated earlier, in the process of duplication the electrostatic master surface is charged uniformly whereby the dielectric image deposits contained thereon acquire electrostatic charges for the attraction of secondary toner material thereto whereas the background or non-image areas remain free of such charges. Accordingly the coating on the paper base of the duplicating master must be sufficiently conductive to prevent the background or non-image areas thereon from accepting electrostatic charges of sufficient magnitude to attract secondary toner material thereto which may form objectionable fog or stain in such background areas. Such conductive coating may comprise a water soluble quaternary ammonium polymer or other such like materials as are commonly used in the preparation of conductive or relatively conductive coatings in electrostatographic recording members and such paper base may also contain on at least one side thereof a so-called carrier barrier coating as is also well known in the art to prevent or reduce solvent absorption by the paper base of solvent in case the secondary toner is of liquid type to enable immediate reuse of the master without completely drying same if so desired for the generation of a subsequent copy. Generally however the duplicating master is dried with heat or warm air prior to reuse for the generation of a subsequent copy.

The secondary toner may be of the dry or liquid type and such toner material should have very good electrostatic transfer properties that is to say upon transfer onto the copy paper it should leave no residue on the dielectric image deposits contained on the master surface or if some residue is left thereon it should not impair the dielectric properties or affect the subsequent charge acceptance thereof which is particularly important in those instances where such secondary toner material contains electrically conductive pigments such as carbon black and the like. The composition of the secondary toner material should be of the kind which allows for the secondary toner deposits upon transfer onto the copy paper to be affixed thereto by pressure, heat, warm air, solvent evaporation or other preferred methods.

The conductive coated paper for the duplicating master can be of inexpensive type however it should be so selected with regards its thickness and bulk as well as solvent resistance that it can withstand mechanical fatigue and recycling during the process of duplication for the required run length.

The copy paper type is usually determined by economic considerations and MG (machine glazed) paper and other similar cheap grades of paper have been found suitable.

It has been stated in the foregoing that after transfer of dielectric primary toner deposits from the dielectric paper plotter output onto the conductive coated paper it is important that virtually no residue remains on the dielectric paper. This is necessary to permit reuse of the expensive dielectric paper in that we have found that the dielectric paper can be reused many times in the plotter provided its dielectric properties are not affected or not substantially affected by the formation thereon and subsequent transfer therefrom of primary toner deposits. In those instances where after transfer some residue of primary toner remains on the dielectric paper surface, upon reuse of such dielectric paper the slight primary toner residue remaining on its surface does not affect significantly the electrostatic pattern formed thereon by the signal addressed styli because such residue is itself dielectric and accordingly may only slightly affect the level of charges formed by said styli and correspondingly it may affect only slightly the quantity of primary toner material attracted thereto upon retoning, however when the primary deposits formed during retoning are transferred onto the conductive coating on the paper base master we have found that even very slight traces of such residue remaining from the preceding toning step on the dielectric paper surface will also transfer onto the conductive coating and produce an objectionable "ghost" image corresponding to the preceding pattern on the dielectric paper which during the process of duplication will attract secondary toner material and thus will be reproduced on the copies generated from such master. In order to prevent the transfer of such slight primary toner residue from the dielectric paper we found it necessary to affix it thereto prior to reuse of such dielectric paper by applying heat or warm air to at least one side thereof.

When the electrostatic field is applied to transfer the primary toner deposits from the dielectric paper onto the conductive coating on the paper base master such field induces on the dielectric paper surface an overall electrostatic charge of a greater or lesser magnitude, depending on the configuration and materials employed, and such charge remains for some time on the dielectric paper surface after the transfer step and after the conductive coated paper base master has been separated therefrom. Prior to reusing such dielectric paper in the plotter it is necessary to neutralize such overall charge thereon otherwise such charge will attract primary toner to the dielectric paper surface causing an overall background stain or fog thereon and consequently also on the master and the copies generated therefrom. Such overall charge may be neutralized for instance by subjecting the dielectric paper after the transfer step to an overall AC corona discharge or other static eliminator means. Surprisingly we have found that if during the step of affixing after transfer slight residue of primary toner onto the dielectric paper as disclosed in the foregoing the heat or warm air is applied to the reverse side of such dielectric paper that is to the side opposite to that containing the dielectric coating such heat or warm air will also neutralize the residual overall electrostatic charge whereas if such heat or warm air is applied to the front surface that is to the dielectric coating on such paper no charge neutralization or no complete charge neutralization occurs.

In those instances where only a few markers or copies are required and thus it may not be economical to produce a master on conductive coated paper, we have found that the primary deposit can be advantageously transferred directly from the dielectric paper onto the copy paper to generate a marker and the primary image deposit can be affixed to the copy paper by heat or warm air while the dielectric paper can be reused as disclosed in the foregoing.

We have also found surprisingly that if the dielectric primary toner deposit is transferred from the dielectric paper directly onto the copy paper such as machine glazed or other such like cheap paper such copy paper can itself be used as an electrostatic duplicating master for the generation of further copies or markers. The image quality of the copies or markers obtainable from such copy paper base master depends mainly on the conductivity of such copy paper which in absence of any special conductive coating depends on its moisture content, the nature of chemicals contained therein and the nature of the paper base itself. If the moisture content is low, the resistivity of the paper may be sufficiently high to accept electrostatic charges during the process of duplication not only on the dielectric primary image deposits contained thereon but also in the non-image areas and this results in attraction of the secondary toner thereto with consequent fog or stain formation of greater or lesser density on the copies or markers generated therefrom. In those instances however where the moisture content of the copy paper is relatively high or its conductivity per se is relatively high, good quality and virtually fog-free copies or markers can be generated. In those instances where the secondary toner is of the liquid type, it is preferable to dry the master by means of heat or warm air after transfer therefrom and prior to reuse for the generation of a subsequent copy particularly where the paper base of the master comprises cheap grade solvent absorbent paper. Such drying or solvent evaporating has been found to be of advantage in reducing the fog level on the subsequent copy or marker generated from such master in that residual solvent in the master base paper increases its resistivity and thus allows the background areas to accept electrostatic charges and to attract secondary toner in background areas. The number of copies or markers which can be generated from such copy paper base master depends mainly on its thickness and bulk which determine to what extent it can withstand mechanical fatigue and recycling during the process of duplication.

It will be realised that in those instances where only a few copies or markers are required and where such copies are generated by direct transfer from the dielectric paper plotter output onto copy paper as disclosed in the foregoing, the toner used for the formation of image deposits on the dielectric paper need not be of the dielectric type and any suitable transferable toner can be used to produce visible images on the copies or markers. It should be noted however that the toner must be so selected that the residue remaining after transfer on the dielectric paper does not affect its dielectric properties and thereby impair its reusability as may be the case for instance if such toner contains carbon black or other such like conductive pigments or materials.

DESCRIPTION OF THE DRAWINGS

In order that the invention may be more fully understood, reference will now be made to the drawings in which FIG. 1 illustrates a preferred method for the production of a plotter master by transfer of primary toner deposits from the surface of a dielectric recording member to a receptor surface, such as a conductive paper surface which forms the receiving member, whereas

Referring now to FIG. 1 in detail, dielectric recording member 1, in web form, is fed from feed reel 2, the dielectric coated side of recording member 1 being on the lower side thereof, to contact recording nibs 3. Contact of the dielectric surface of dielectric recording member 1 with recording nibs 3 is maintained by pressure applied by grounded backing member 4 which contacts the rear relatively conductive surface of dielectric recording member 1. The electrostatic latent image impressed on the dielectric surface of dielectric recording member 1 is toned by the application of liquid dispersed toner from toner fountain 5, forming a first developer station, excess toner being returned to toner tank 6. Toned dielectric recording member 1 then passes over guide roller 7, which may advantageously be the primary drive roller, to pass face up over delivery tray 8. The previous description refers to known equipment such as for instance a Versatec plotter.

Figure 1:
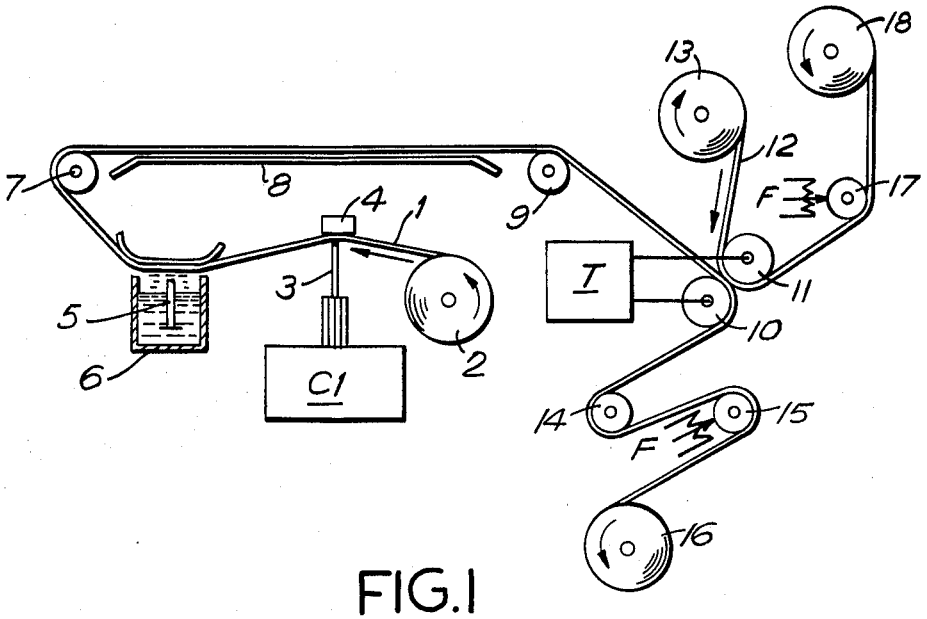

To effect transfer of the primary toner deposit from the dielectric recording member 1 to a receiving member such as a conductive paper web, toned dielectric recording member 1 passes from delivery tray 8 over guide roller 9 and enters the nip between transfer roller pair 10 and 11 which form a first transfer station. Simultaneously copy paper 12 is fed from feed roller 13 to pass through the nip between transfer roller pair 10 and 11 in contact with the toned dielectric surface of dielectric recording member 1. A directional electrostatic field applied in known manner between transfer roller pair 10 and 11 causes transfer of the toned image deposit from the surface of dielectric recording member 1 to receiving member 12. Dielectric recording member 1 then passes over guide roller 14 and fuser roller 15 to take-up reel 16. Receiving member 12 passes around fuser roller 17 to take-up reel 18. Receiving member 12 after transfer of the dielectric image thereto and fusing of same thereon constitutes a master from which markers can be produced.

Figure 2:
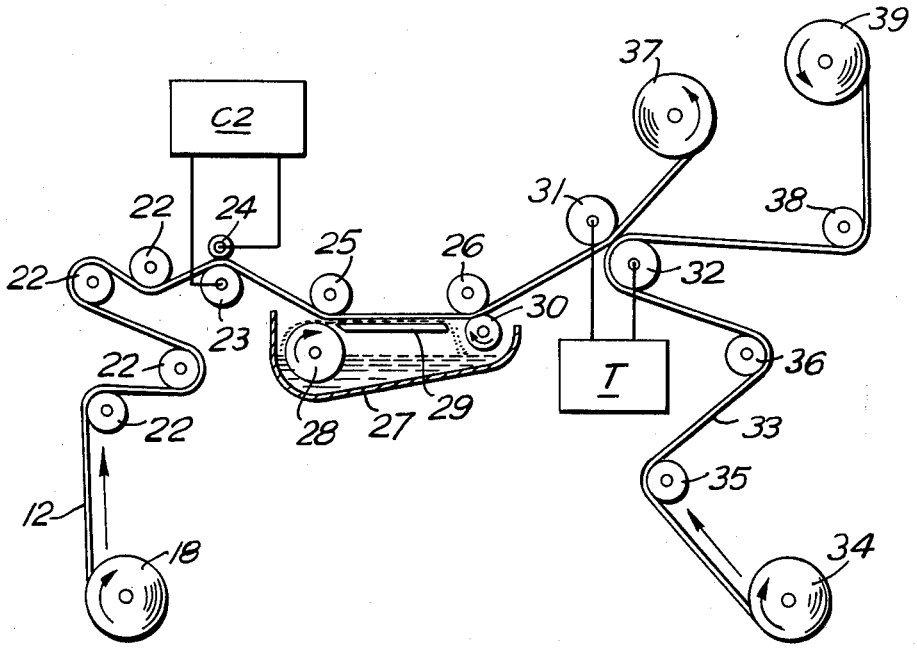
FIG. 2 illustrates the use of such master to produce copies on a plain low cost paper web, the thus produced copies being markers as herein defined.

FIG. 2 illustrates the process steps involved in the production of markers from dielectric masters prepared for instance as described in relation to FIG. 1. The dielectric master 12 of FIG. 1 is fed from feed reel 18 over a series of guide rollers 22 to charging station comprising semi-conductive charging roller 23 which contacts the image bearing surface of dielectric master 12 and grounded backing roller 24 which contacts the back surface of dielectric master 12. A voltage of 100–2000 volts is applied to semi-conductive roller 23, which preferably has a conductive central spindle, to impress an electrostatic charge on the dielectric image deposit on the surface of dielectric master 12. Such charge may be positive or negative as desired, depending on the polarity of the secondary toner. The toning unit comprises guide rollers 25 and 26, toner tank 27, toner applicator roller 28 and developing plate 29. Toner contained in tank 27 which forms a second developer station, is lifted by toner applicator roller 28 which rotates in the direction shown to flow across developing plate 29, which is positioned in relation to guide rollers 25 and 26 to cause the surface of dielectric master 12 to contact the toner on developing plate 29. Solvent limiting roller 30 rotating in the direction shown and spaced apart from the dielectric master surface 12 a distance generally within the range 1–20 mils, may be used if desired to restrict the amount of dispersant liquid from the toner which is carried out by the master.

The toned dielectric master 12 next enters the nip between a pair of transfer rollers 31 and 32, which form a second transfer station, at which position it contacts copy web 33. Copy web 33 is contained initially on feed reel 34, from which is passes over guide rollers 35 and 36 to enter the nip between transfer rollers 31 and 32. A directional electrostatic field is applied in known manner between transfer rollers 31 and 32 to transfer copy toner contained on the image areas of dielectric master 12 to copy web 33. Transfer voltage is of the order 100–2000 volts of a polarity dependent on the polarity of the copy toner. Dielectric master 12 is finally re-reeled on take-up reel 37 whereas copy web 33 passes over guide roller 38, which may be heated if desired to fuse the toner deposit contained on copy web 33, and finally is re-reeled on take-up reel 39.

Each of the transfer rollers 10 and 11 of FIG. 1 and 31 and 32 of FIG. 2 is preferably constructed by cast coating of soft polyurethane elastomer coating over a conductive metal spindle. The polymethane should preferably be of Durometer hardness within the range 18–30 Shore A. Such elastomeric coatings have been found to be of sufficient resilience to compensate for minor surface irregularities and to be of such resistivity that they limit the transfer current flow to a safe level, such as 20–50 microamps/meter of length at an applied DC voltage of 500 volts. The elastomer coating is normally 3–5 millimeters in thickness.

In the drawings transfer field supply units are designated T while charging fields are produced by units designated C1 and C2, the unit C1 being a pattern-determining unit. Fusing stations are designated by F1.

The dielectric master 12 can be wound from the take-up reel 18 to a separate supply reel and then to a further take-up reel instead of transferring the reels and master as illustrated in the drawings.

DESCRIPTION OF THE PREFERRED EMBODIMENTS

Examples

The following Examples will serve to further illustrate the invention.

Example 1

The primary transferrable dielectric liquid toner was prepared as follows:

Ketone resin, cyclohexanone formaldehyde, type—100 grams
Graphthol Red 1630-1 pigment—20 grams
FOA2—50 grams
Zirconium Octoate (6% metal)—5 grams Isoparaffinic hydrocarbon—400 grams
were ball milled for 96 hours to form the toner concentrate. The primary liquid toner was made up by dispersing 20 to 50 grams of the above concentrate in 1000 grams of isoparaffinic hydrocarbon.

In the above formulation the Graphthol Red 1630-1 pigment is made by Sandoz and the FOA2 is a fuel additive made by DuPont.

A secondary transferrable black liquid toner was prepared as follows:
Microlith Black CT—50 grams
Microlith Blue 4GT—25 grams
Pentalyn H—15 grams
Paraffin Wax, melting point 60° C.,—20 grams
Zirconium Octoate (6% metal)—5 grams
Isoparaffinic hydrocarbon—400 grams
were ball milled for 96 hours to form the toner concentrate. The secondary liquid toner was made up by dispersing 10 to 20 grams of the above concentrate in 1000 grams of isoparaffinic hydrocarbon.

In the above formulation the Microlith Black CT and Microlith Blue 4GT were made by Ciba-Geigy and the Pentalyn H is a pentaerythritol ester of rosin made by Hercules Inc.

A commercially available dielectric paper with a thickness of 0.003 inch having a surface resistivity of $7\times10^{14}$ ohms/cm$^2$ on its dielectric coated side was fed at the speed of 0.6 inches per second through a plotter having signal addressed styli with a writing potential of 400 volts negative which formed on the dielectric paper latent electrostatic images of about 250 volts negative. The dielectric paper surface was then contacted with the above disclosed primary liquid toner to form primary dielectric toner deposits thereon. Immediately after toning, that is while the image bearing dielectric paper surface was still wet, the dielectric paper was contacted with the conductive coated side of the paper base for the master and the sandwich was passed through a pair of rollers to effect electrostatic transfer of the primary dielectric toner deposits from the dielectric paper onto the conductive coating of the paper base master. The conductive coated paper was 0.003 inch thick, the surface resistivity of the conductive coated side was less than $10^5$ ohms/cm$^2$. The roller located behind the dielectric paper was of metal and kept at ground potential whereas the roller located behind the conductive coated paper comprised a metal cylinder having a semi-conductive rubber coating thereon and to effect electrostatic transfer a potential of 700 to 1000 volts negative in relation to ground was applied to said metal cylinder. A very slight residue remained after transfer of the dielectric paper.

After transfer the dielectric paper was passed over a heated roller in such manner that the reverse side, that is the side opposite to the dielectric coated side, contacted the roller surface which was kept at a temperature of about 120° C. whereby the slight primary toner residue on the dielectric paper became affixed thereto and the overall electrostatic charge of about 20 volts induced thereon during the step of transfer has been completely neutralized.

The dielectric paper was reused 10 times where each resuse comprised the steps of feeding through the plotter, toning, transferring and heating, all carried out at the speed of 0.6 inches per second, as above disclosed. All 10 masters produced by reusing the dielectric paper were identical as far as master and copy image quality are concerned to the first master produced before reuse and to the copies generated therefrom. No "Ghost" images of preceding patterns nor background fog were evident.

The primary dielectric toner deposits transferred onto the conductive coating of the paper base master were fused thereto by passing at the speed of 0.6 inch per second the master over a heated roller in such manner that its reverse side contacted the roller surface which was kept at a temperature of about 120° C.

Copies were then generated from the thus prepared master at the speed of 45 feet per minute in the following manner. The master was passed over a metal roller held at ground potential and a corona generator held at 8 KV negative potential was positioned above such roller facing the conductive coated side of the master whereby the dielectric primary image deposits contained thereon became electrostatically charged to a potential of about 200 volts negative. The secondary black toner as disclosed in the foregoing was then applied to the master surface to form secondary toner deposits on the primary image deposits. The toned master was then contacted with 0.0024 inch thick machine glazed copy paper and the sandwich was passed through a pair of rollers to effect electrostatic transfer of the secondary toner deposits from the master onto the copy paper. The roller located behind the master was of metal and kept at ground potential whereas the roller located behind the copy paper comprised a metal cylinder having a semi-conductive rubber coating thereon and having a potential of about 500 volts negative applied to said metallic cylinder.

After transfer the copy paper was separated from the master. Warm air was applied to the copy paper to dry it and to affix the secondary toner deposits. The master was dried by passing it over a heated roller having a surface temperature of about 80°-100° C.

The dry master was then reused to generate further copies in the same manner as above described. In excess of 100 copies were generated from the master and all copies showed good image quality.

EXAMPLE 2

The primary dielectric toner deposit formed on the dielectric paper as disclosed in Example 1 was electrostatically transferred onto machine glazed copy paper, 0.0024 inch thick. To effect transfer a potential of 1200 volts negative was applied to the metal cylinder.

The primary toner deposit transferred onto the copy paper was affixed thereto by the application of warm air.

The affixed primary toner deposits formed a visible image of reddish colour on the copy paper. This produced a marker.

The dielectric paper was reused as disclosed in Example 1.

EXAMPLE 3

The dielectric paper was fed through the plotter and toned as disclosed in Example 1 except that the dielectric paper was toned with the secondary black toner of Example 1.

The black toner deposit thus formed on the dielectric paper was electrostatically transferred onto machine glazed copy paper, 0.0024 inch thick. To effect transfer of potential of 500 volts negative was applied to the metal cylinder.

The black toner deposit transferred onto the copy paper was affixed thereto by the application of warm air. This produced a marker.

The dielectric paper was reused.

EXAMPLE 4

The primary toner deposit transferred onto the machine glazed 0.0024 inch thick copy paper of Example 2 was fused thereto by passing at the speed of 0.6 inch per second the copy paper over a heated roller in such manner that its reverse side contacted the roller surface which was kept at a temperature of about 120° C. This produced a duplicating master on copy paper base. The surface resistivity of the copy paper was about $5\times10^{11}$ ohms/cm$^2$.

The thus produced duplicating master was used in the electrostatic duplication process as disclosed in Example 1 except that to effect transfer of the secondary toner deposits from the master onto the copy paper a potential of about 600 volts negative was applied to the metallic cylinder.

In excess of 20 copies or markers of acceptable image quality were generated from the copy paper base master.

After each copy generation and preparatory to each reuse the master was dried as disclosed in Example 1.

There have been described new methods of producing inexpensive electrostatic duplicating masters from a reusable expensive dielectric paper and a method of generating copies from such master and from such dielectric paper. The methods and materials specifically disclosed herein are intended to only illustrate the present invention without limiting its scope in any way.

We claim:

1. A method for the production of markers for the cutting of fabric or material in the garment and allied industries comprising the steps of forming an electrostatic latent image on the surface of a dielectric recording member defining the shape of fabric pieces to be cut, toning said electrostatic latent image with a primary toner which is capable of holding an electrostatic charge when fused to a surface, transferring said primary toner deposit from said dielectric recording member to a receiving member the surface of which is relatively incapable of holding an electrostatic charge in comparison with said primary toner deposit, fixing said primary toner deposit to said receiving member surface to form an electrostatic master, electrostatically charging said fixed primary toner deposit on said electrostatic master, toning said primary toner deposit on said electrostatic master with a secondary toner, and transferring electrostatically said secondary toner to a surface while simultaneously retaining said fixed primary toner deposit on said electrostatic master whereby to mark the said surface with the said secondary toner but retaining said master for forming further copies.

2. The method for the production of markers as in claim 1 wherein the said secondary toner is transferred to a copy member, and by the further step of using the said copy member as a marker by transferring secondary toner from the said copy member to the surface to be marked.

3. The method for the production of markers as in claim 1 or 2 wherein the said primary toner deposit is transferred from the said dielectric recording member to the said receiving member by the application of an electrostatic field.

4. The method for the production of markers as in claim 1 or 2 wherein the said primary toner deposit is fixed to the said receiving member by the further step of applying heat thereto.

5. A method for the production of markers as in claim 1, further characterised by said dielectric recording member being re-used at least once after transfer of said dielectric toner deposit therefrom.

6. A method for the production of markers as in claim 2, further characterised by said electrostatic master being used to produce by re-charging, re-toning and transfer a multiplicity of markers on said copy members.

7. The method for the production of markers as in claim 1 or 2 characterised by the further step of heating the dielectric recording member, after transfer of the said primary toner therefrom, from the side which does not contain the said primary toner to fix toner residue and neutralize electrostatic charges for re-use of the said dielectric recording member.

8. The method for the production of markers as in claim 7 characterised by the further step of evaporating any solvent held on the said dielectric recording member prior to the said heat-fixing step.

9. The method for the production of markers as defined generally in claim 1 characterised by the steps of (a) feeding the said dielectric recording member past recording nibs and applying an electrical signal thereto to establish a marking pattern, (b) passing the said dielectric recording member through a first developer station to apply a primary insulating toner to areas conditioned by the said signal, (c) passing the said dielectric recording member through a first transfer station between rollers while maintaining a transfer field between the said rollers, (d) feeding the said recording member forward to also pass through the said first transfer station in close contact with the said dielectric recording member to receive the said primary insulating toner, (e) passing the said receiving member over heating means to fuse the said primary toner to the said receiving member, to form a said master, (f) feeding the said electrostatic duplicating master through a charging station to charge the said primary toner on the said electrostatic duplicating master, (g) passing the said electrostic duplicating master through a second developer station to apply the said secondary toner, and using the said electrostatic duplicating member so formed to produce multiple copies of the said marking pattern.

10. The method for the production of markers as in claim 9 further characterised by the steps of (h) passing a copy member between rollers simultaneously with the said electroscopic duplicating master with the said second toner pattern in face contact with the said copy member while maintaining a transfer field between the said rollers, (i) optionally passing the said copy member over a heating roller, and (j) using the said copy member as a marker.

11. The method for the production of markers as in claim 1 characterised in that (a) the said primary toner is transferred electrically, (b) the said primary toner deposit is fixed to the said receiving member by the application of heat thereto to fuse the said primary toner deposit to the said receiving member, and (c) the said secondary toner is transferred electrically to a copy member and is fixed to the said copy member whereby to produce a marker.

12. The method for the production of markers as in claim 11 characterised in that (d) the said dielectric recording member is fed past recording means to apply an electrical marking pattern thereto and the said electrical marking pattern is developed by the said primary toner, (e) the said dielectric recording member with the primary developer pattern thereon is passed between rollers in contact with the said receiving member while maintaining a transfer field between the said rollers, (f) the said primary toner on the said receiving member is charged by passing the said member over a semi-conductive roller while maintaining an electrical field between a spindle of the said roller and a roller on the other side of the said member to impress the said charge on the said primary toner, and (g) the said secondary toner after application to the said primary toner is fixed to the said copy member by passing the said copy member over a heated roller with the said toners outward from the said heated roller.

13. The means for the production of markers for the cutting of fabric or material in the garment or allied inudstries which comprise means to form a latent electrostatic image pattern on the surface of a dielectric master, means for toning the said image pattern with a primary toner of a relatively insulating nature, means for transferring the said toner to a relatively conductive receiving member and fixing thereto to produce a master, and means for charging the said primary toner image pattern and applying a secondary toner thereto to form a transferable secondary image pattern for transfer optionally to the said fabric or material or to multiple copy members for marking the said fabric or material.

14. Means for the production of markers for the cutting of fabric or material in the garment and allied industries according to claim 13 comprising, a first section having a pattern recording station to produce on a dielectric recording member an electrostatic pattern, means to develop the said pattern by a primary developer capable of retaining an electrostatic charge, means to transfer the said primary developer pattern to a relatively electrically conductive surface on a receiving member, and means to fix the said primary developer pattern to the said electrically conductive surface on the said receiving member to form a re-usable master, and a second section having a charging station to apply an electrostatic charge to the said master whereby to retain the said charge on the said primary developer image, and a developer station to apply a secondary developer, which forms the medium for marking, to the said receiving member to retain the said marking medium on the said primary developer pattern, whereby the said marking medium can be optionally applied to a fabric or material or to a copy member for marking the said fabric or material.

15. Means for the production of markers for the cutting of fabric or material in the garment and allied industries as generally defined in claim 14 comprising, first supply and take-up means for a dielectric recording member means to move the said dielectric recording member along a predetermined path from the said supply means to the said receiving means to pass same successively through a recording station, a primary image toning station, a transfer station where it is in contact with an image receiving member, and optionally a fusing station, said recording station comprising means to apply an electrical pattern to a face of the said dielectric recording member to define the pattern of the marker on that face of the dielectric recording member, said toning station comprising means to apply to the said dielectric recording member electrical image pattern a primary toner which is selected to be capable of holding an electrostatic charge when fused to a surface, said transfer station comprising a pair of adjacently placed parallel rollers adapted to have the said dielectric member pass therebetween in face contact with a receiving member having at least a conductive front face to contact the said dielectric recording member, said rollers being formed of at least semi-conductive material, and means to apply a directional field between the said rollers, said fusing station when used comprising a roller and means to apply heat thereto arranged to contact the back surface of said dielectric recording member and dry any primary toner remaining after the said transfer, whereby said dielectric recording member may be stored at said receiving means for reuse, and second supply and take-up means for the said receiving member and means to move the said receiving member on a determined path including movement through the said transfer station, and a fuser station comprising a roller and means for heating same arranged to contact that surface of the receiving member opposite the toner-containing surface whereby to form a master with a relatively conductive surface containing on it a pattern of insulating material.

16. The means of claim 15 characterised by means to allow pattern transfer from the said master to a further surface comprising, a second charging station to charge the said pattern of primary toner, and a second toner station to apply a secondary toner to the electrostatically charged primary toner, whereby said secondary toner can be transferred to a surface as marking means and the said master can be used repetitively to effect further marking.

17. The means of claim 16 wherein the said second developer station comprises, a toner tank, an applicator roller in the said toner tank to extend into the said developer space in the said tank, means to drive the said roller to lift developer on to a plate to flow between the said plate and the said master to contact the charged image with the said developer.

18. The means of claim 16 wherein the said second charging station comprises a roller of semi-conductive material surrounding a conductive spindle, and a conductive backing roller adjacent thereto both arranged to have the said receiving member pass therebetween with the said primary toner image in contact with the face of the said semi-conductive roller, and by means to apply a directional electrical field between the said rollers.

19. The means of claim 16 characterised by, third supply and take-up means for a copy member and means to move the said copy member on a determined path including movement through a second transfer station positioned in the said path of the said receiving member and comprising a pair of adjacently placed parallel rollers adapted to have said receiving member pass therebetween with the image-bearing face of the said receiving member in contact with the said copy member, said rollers being formed of at least semi-conductive material, and means to apply a directional field between the said rollers, whereby the said secondary developer is transferred to the said copy member, and the said receiving member is usable repeatedly to form further markers.

20. The means as in claim 16 in which the said first and the said second supply and take-up means are reels adapted to carry the said dielectric recording member and the said receiving member respectively which are of elongated form, and means to drive the said dielectric recording member and the said receiving member at the same linear speed whereby the stations for pattern production primary development, charging, secondary development and transferring are carried on progressively as the said dielectric recording member and the said receiving member traverse the said stations.

21. The means as in claim 20 in which the said third supply and take-up means are reels adapted to carry the said copy member which is of elongated form, and means to drive the said copy member at the same linear speed as the said receiving member.

* * * * *